United States Patent [19]

Nasypany

[11] 4,088,057

[45] May 9, 1978

[54] RECOIL REDUCING AND PISTON SHOCK ABSORBING MECHANISM

[75] Inventor: Paul Nasypany, Herkimer, N.Y.

[73] Assignee: Remington Arms Company, Inc., Bridgeport, Conn.

[21] Appl. No.: 747,204

[22] Filed: Dec. 3, 1976

[51] Int. Cl.[2] ..... F41F 3/02

[52] U.S. Cl. ..... 89/1.701; 42/1 V; 89/193; 89/198

[58] Field of Search ..... 42/1 V, 1 W, 74; 89/1.7, 1.701, 42 R, 43 R, 177, 191, 198

[56] References Cited

U.S. PATENT DOCUMENTS

| | | | |
|---|---|---|---|
| 836,502 | 11/1906 | Johnson | 89/198 |
| 1,176,873 | 3/1916 | Swebilius et al. | 89/198 |
| 1,388,856 | 8/1921 | Fox | 89/198 |
| 3,298,282 | 1/1967 | Loffler et al. | 89/198 |

*Primary Examiner*—Stephen C. Bentley
*Attorney, Agent, or Firm*—Nicholas Skovran; William L. Ericson

[57] ABSTRACT

A firearm recoil system that reduces the maximum recoil force felt by the shooter. The recoil force applied to the shooter's shoulder is interrupted by tapping off explosive gases produced by firing a cartridge and directing the gases into a gas cylinder to actuate a piston rearwardly and at the same time provide a forward force to the firearm opposite to the rearward recoil movement of the firearm. The rearward piston movement is slowed down by compressing air trapped within the cylinder and then venting the compressed air so that the remaining recoil energy in the piston is gradually phased out. This results in a substantially lesser peak or maximum shoulder force.

6 Claims, 10 Drawing Figures

RECOIL REDUCING AND PISTON SHOCK ABSORBING MECHANISM

The present invention relates to a recoil system for a firearm that reduces the recoil force felt by the shooter. More particularly, the invention relates to a recoil system that utilizes explosive gas pressure to reduce the peak recoil force applied against a shooter's shoulder. Still more particularly, the explosive gas pressure is used to apply a force to the firearm in a direction away from the shooter's shoulder while at the same time causing a slidable inertia weight that is positioned in a closed cylinder to move toward the shooter's shoulder where it is pneumatically dampened so that the effect of the inertia weight is phased out gradually to the shooter's shoulder.

It has been apparent for some time that while the total work done by the recoil (force times time; or the area under a plot of force vs. time) is always essentially the same for equal weights of gun and equivalent loads, the recoil effect experienced by shooters varies widely. By using a gauge of the type shown in U.S. Pat. No. 2,642,741, issued June 23, 1953 to F. G. duPont, it was possible to identify one measurable phenomenon which correlated with the shooter's report of recoil effect. This phenomenon is the peak value of force exerted against the shoulder of a shooter firing in the usual offhand fashion. The peak value of force exerted against any individual shooter's shoulder depends to some degree on the rigidity with which the shoulder resists the force of recoil. The subjective aspects of this phenomenon have long been recognized and shooters have been characterized as "heavy" or "light" shoulder shooters. The "heavy" shouldered shooter pushes the gun stock solidly into his shoulder before firing so that gun recoil movement is immediately transmitted to his shoulder. A "light" shouldered shooter holds the gun loose so that there is some initial "take-up" of recoil movement in his clothing and the fat in his shoulder. It is believed that the peak shoulder force, rather than the total recoil force, is the proper measure of gauging or determining recoil sensation of a shooter in the normal, offhand position. Maximum values of reduction in recoil effect are realized in the less rigid or "light" shouldered shooters.

The present invention results in lower peak recoil forces in both "heavy" and "light" shouldered shooters, as will be shown below.

The use of explosive gases from fired cartridges to actuate actions is old and well known. Further, the use of spring or pneumatic dampening devices to reduce recoil effect also is not new. Representative patents include the following U.S. Pat. Nos. 2,777,366 issued to L. C. Cook on Jan. 15, 1957; 2,895,383 issued to F. P. Reed on July 21, 1959; 3,298,282 issued to T. Loffler et al on Jan. 17, 1967; and 3,683,534 issued to Marvin Davis on Aug. 15, 1972.

The present design directs a portion of the gas pressure from the fired round into a cylinder rigidly mounted on the gun. The cylinder contains a movable inertia weight and a seal ring rigidly fixed to the cylinder. The gas pressure is trapped in a relatively small volume gas chamber confined by the movable inertia weight and the fixed seal ring so that the gas pressure provides a force rearwardly against the inertia weight to move the inertia weight relative to the gun toward the butt stock and at the same time exerts a force on the fixed seal ring thus tending to move the attached gun forwardly away from the shooter's shoulder. Because the inertia weight is free of the gun, gas pressure acting on it does not immediately push the gun rearward into the shooter's shoulder. However, gas pressure acting against the fixed seal ring (and thus also the cylinder and the gun) pushes the gun forward away from the shooter's shoulder, thereby reducing the recoil forces felt by the shooter.

Because the inertia weight must be stopped, a means must be provided to prevent violent contact between the inertia weight and the breech plug connected to the rear end of the gas cylinder. Otherwise, an additive recoil force similar to that caused by recoiling barrel designs would be experienced by the shooter.

The present design limits the amount of time during which the gas pressure acts against the inertia weight. When the inertia weight has moved rearward a short distance, a relief ports are exposed which allow the gas pressure to drop rapidly thus ceasing to drive the inertia weight. In short, a quick movement is imparted to the inertia weight by the gas pressure.

Air trapped between the inertia weight and the breech plug at the end of the cylinder is compressed and then metered through a vent, thus decreasing the inertia weight velocity enough to soften or eliminate any contact between it and the breech plug. To prevent metal to metal contact between the breech plug and the inertia weight, the breech plug is faced with a buffering material. Finally, a compression spring is used to return the inertia weight to battery position.

The present design, that stops or slows down the inertia weight, is self-compensating in that the greater the inertia weight velocity-and thus the increased force needed to stop it-the greater the trapped air pressure becomes. The amount of recoil reduction is directly proportional to the weight and velocity of the inertia weight. However, a compromise is necessary in determining the heaviest mass possible consistent with keeping the gun weight down.

Finally, the inertia weight or piston assembly is designed-along with the details of the cylinder-to permit removal of the entire inertia weight unit from the gun for easier cleaning and assembly.

It is an object of the present invention to provide a recoil attenuating system for a firearm wherein the amount of shoulder force or recoil experienced by a shooter is reduced.

It is another object of the invention to utilize gas pressure from a fired round to decrease the peak recoil force felt by the shooter.

It is still another object of the invention to provide a recoil attenuating system having a gas-operated, pneumatically-dampened inertia piston assembly which is readily removable for cleaning and assembly.

It is yet another object of the invention to utilize explosive gas pressure from a fired round to work with a movable inertia weight which is pneumatically dampened to delay the application of part of the total recoil force to the shooter's shoulder, thus reducing the peak recoil force and the recoil sensation to the shooter.

Other objects and advantages will become apparent from the following description taken in conjunction with the accompanying drawing in which.

Figure 1:
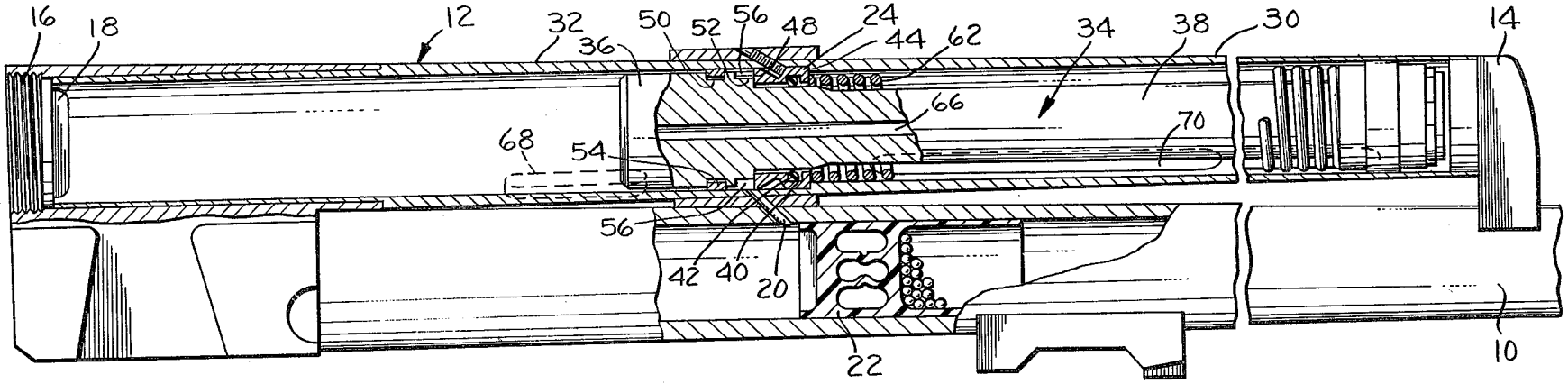
FIG. 1 is a longitudinal cross-sectional view of a barrel assembly with a gas cylinder mounted thereon and the inertia weight positioned therein in battery position.

FIG. 1 shows a gun barrel 10 of the type generally used in over-and-under shotguns. It should be understood, however, that the invention is useful in other types of shoulder-fired firearms as well. Mounted on said barrel 10 by means of a bracket 11 is a gas cylinder 12 with its forward- or muzzle-end closed off by a cap 14 and its rear- or butt-stock end closed off by a threaded breech plug 16. A buffer member 18 is attached to the inside face of the breech plug for a purpose to be explained later.

Located a predetermined distance from the gun chamber (not shown) is a pair of gas ports 20 which permit explosive gases, produced upon firing a cartridge round, to bleed from the gun barrel to the gas cylinder after the projectile—or wad 22 (see FIG. 1)—has passed the gas ports. Obviously, there can be more or less than two gas ports.

Figure 7:
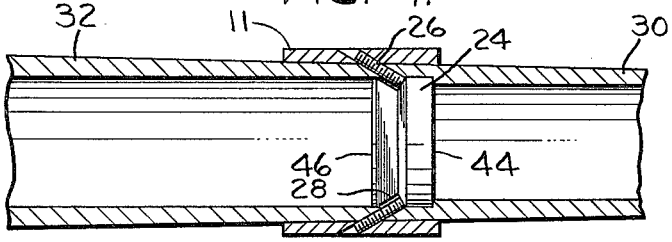
FIG. 7 is a sectional view taken along line 7—7 of FIG. 6 with the inertia weight shown in place to indicate the attaching means for the gas seal ring.
Figure 8:
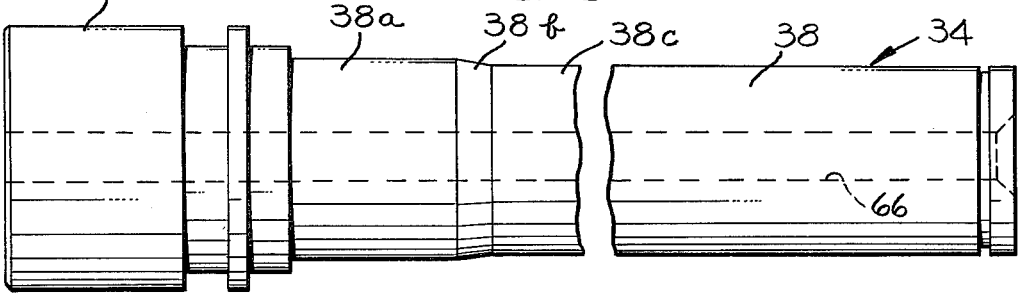
FIG. 8 is a side elevation of a piston assembly which in the present invention functions as an inertia weight.

A piston rod seal ring 24 is rigidly mounted in the gas cylinder 12 and is held thereto by a pair of removable screw means 26 that pass through openings 25 in bracket 11 and cylinder 12 to engage an annular groove 28 in the seal ring (see FIG. 7). The seal ring 24 separates the gas cylinder into a forward cylinder section 30 and a rear cylinder section 32. A piston assembly 34 functions as an inertia weight and comprises a piston head 36 having an outside diameter that is greater than the inside diameter of the rod seal ring 24 through which it slides. The piston rod portion 38*a* then tapers at 38*b* to a smaller diameter forward portion 38*c* for a purpose to be explained later. Piston rod seal ring 24 has an annular gas sealing groove 40 on its inner peripheral wall in which an "O" ring 42 is located to provide the necessary sealing between the sliding piston rod 38 and the seal ring 24.

Seal ring 24 has a front end face 44 and a rear end face 46. Piston head 36 has forward end face 48 that engages the rear end face 46 of the seal ring to limit forward movement of the piston assembly. The piston head 36 also has two annular grooves 50 and 52. Annular groove 50 has a split piston ring 54 positioned therein to seal the gases from moving past the piston head in a conventional manner. Annular groove 52 communicates with gas ports 20 to form a gas chamber 56 for explosive gases generated by firing a cartridge in the gun chamber and bled through the gas ports 20.

The forward end of piston rod 38 (see FIG. 3) has a ring-shaped piston rod spring stop 58 mounted thereon. Spring stop 58 is prevented from moving off the front end of the piston rod 38 by retaining ring 60 and is biased forwardly by coil spring 62 whose front end abuts the spring stop 58 and whose rear end abuts against the front end face 44 of seal ring 24. A groove on the outside periphery of spring stop 58 holds a split sleeve 64 that is made of nylon or some other suitable material.

The piston assembly 34 has a vent opening 66 which extends through the entire length of the piston head and the piston rod. Other gas venting features of the recoil attenuating system include relief ports 68 and 70 in the forward and rear sections of the gas cylinder respectively.

The operation of the present recoil attenuating system can now be explained using FIG. 1 as the starting point. In this Figure, the shotshell cartridge (not shown) has been fired and the wad 22 and shot load (partially shown) are on their way out of the gun barrel (moving toward the right of the drawing). The wad 22 has just passed gas ports 20 and a portion of the explosive propellent gases has been tapped to pass through the gas ports into gas chamber 56 in the gas cylinder 12. The propellent gases cut uniformly in all directions and thus exert pressure against the stationary gas seal ring 24 as well as against the piston head 36. The force against the stationary seal ring is opposite to the normal rearward recoil movement of the gun after firing. The force against the piston head (or actually against the entire piston assembly or inertia weight) is in the same direction as the gun recoil, but the piston assembly is free to move within the gas cylinder 12 so that the force is not applied immediately to the shooter's shoulder.

Figure 2:
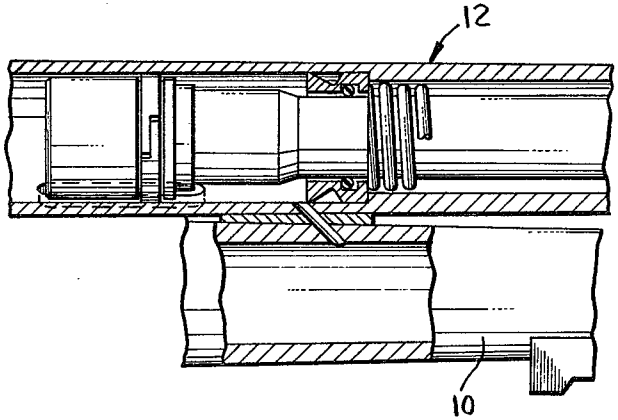
FIG. 2 is a fragmentary longitudinal cross-sectional view of the barrel assembly-gas cylinder combination showing the inertia weight actuated to the left (rearwardly toward the butt stock) and at the point when the explosive gases begin to excape through the relief ports.

The explosive gas pressure is exerted forwardly against the seal ring and rearwardly against the movable piston assembly until the piston assembly reaches the position shown in FIG. 2. At this point, the inertia weight is moving rearwardly at a high velocity and the relief ports 68 are exposed, thus permitting venting of the explosive gases and causing a sharp decrease in pressure. Also, as seen in FIG. 2, the piston rod portion of the inertia weight is no longer in gas sealing relationship with the gas seal ring 24 because the inertia weight has moved rearwardly a sufficient distance to have piston rod portion 38*a* move out of the seal ring. In short, there is now some venting of explosive gases between the inside diameter of the seal ring and the diameter of rod portion 38*c*.

At this point in time, the inertia weight, which is not connected to the gun, moves freely in the gas cylinder and thus is not acting against the shooter's shoulder. However, at the high speed it is moving, it must be brought to a stop gradually so as to not impact against the breech plug. This is done by the dampening effect which results when the air in the rear cylinder portion 32 is compressed between the breech plug and the piston head and then metered through vent opening 66 to the forward cylinder portion 30, where it vents to atmosphere through relief ports 70.

Figure 3:
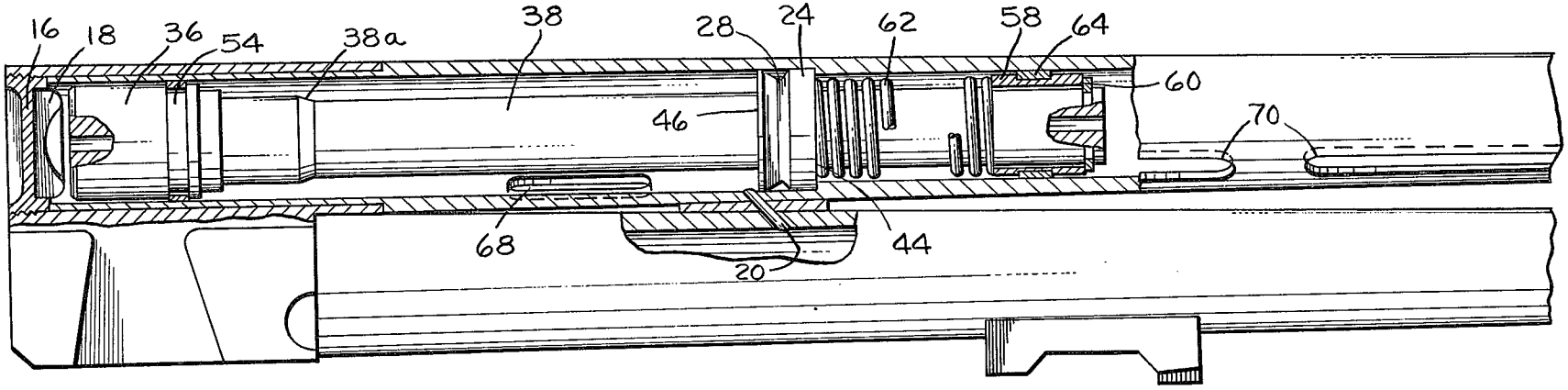
FIG. 3 is a longitudinal cross-sectional view of a barrel assembly-gas cylinder combination in which the inertia weight is at its rearwardmost position, i.e. adjacent the buffer means on the breech plug.
Figure 4:
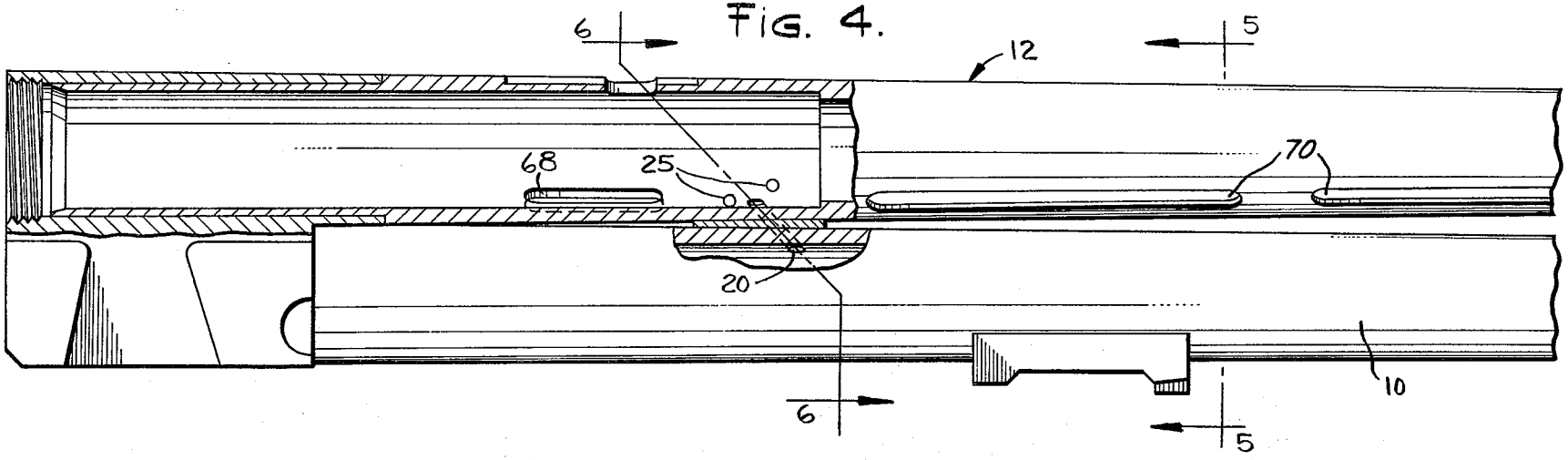
FIG. 4 is a longitudinal cross-sectional view of the barrel assembly-gas cylinder combination without the inertia weight.
Figure 5:
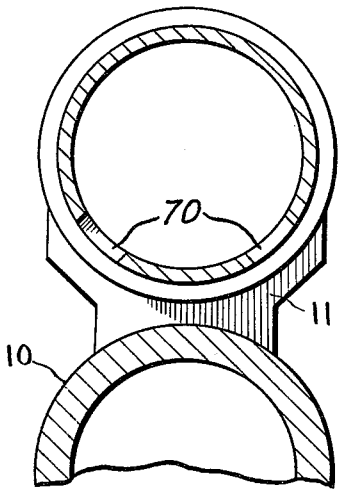
FIG. 5 is a sectional view taken along line 5—5 of FIG. 4.
Figure 6:
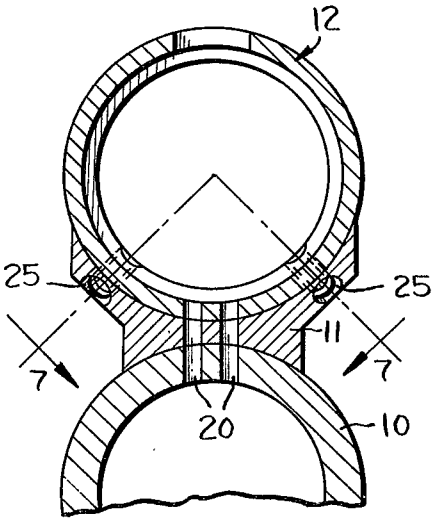
FIG. 6 is a sectional view taken along line 6—6 of FIG. 4.

FIG. 3 shows the inertia weight in its rearwardmost position. Although the piston head is shown almost engaging the buffer 18, tests show that in many cases, the inertia weight comes to rest before it strikes the buffer.

During the time the inertia weight is moving to the rear, the coil spring 62 is being compressed and the energy stored therein so as to return the inertia weight to the forward or battery position.

Figure 9:
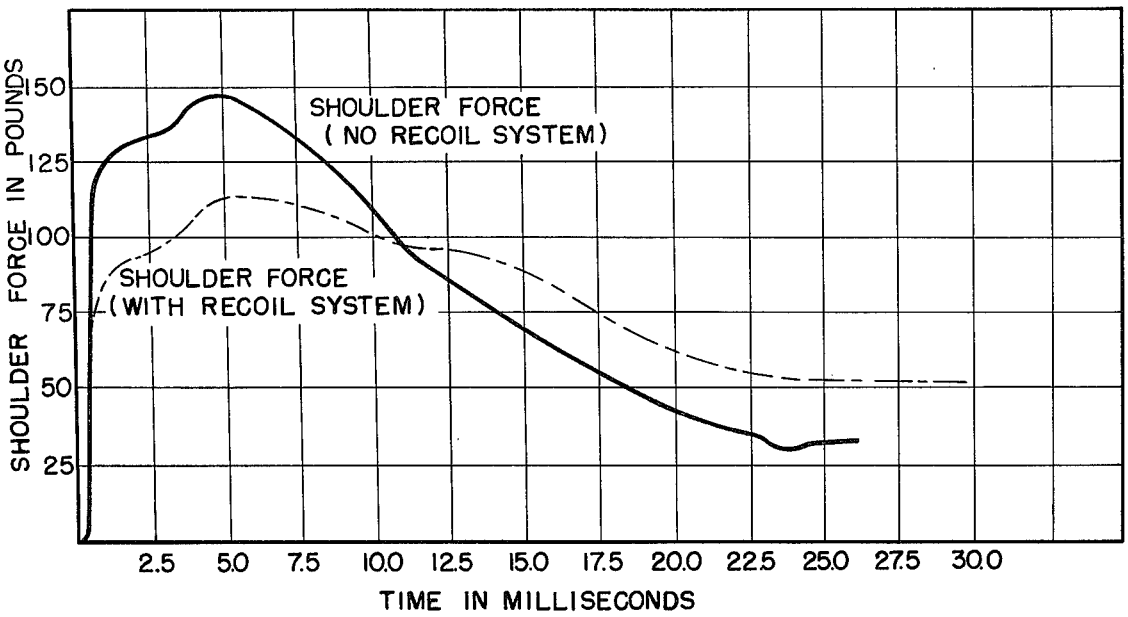
FIG. 9 is a graph showing a representative test plot of shoulder force vs. time for a "light" shouldered shooter.
Figure 10:
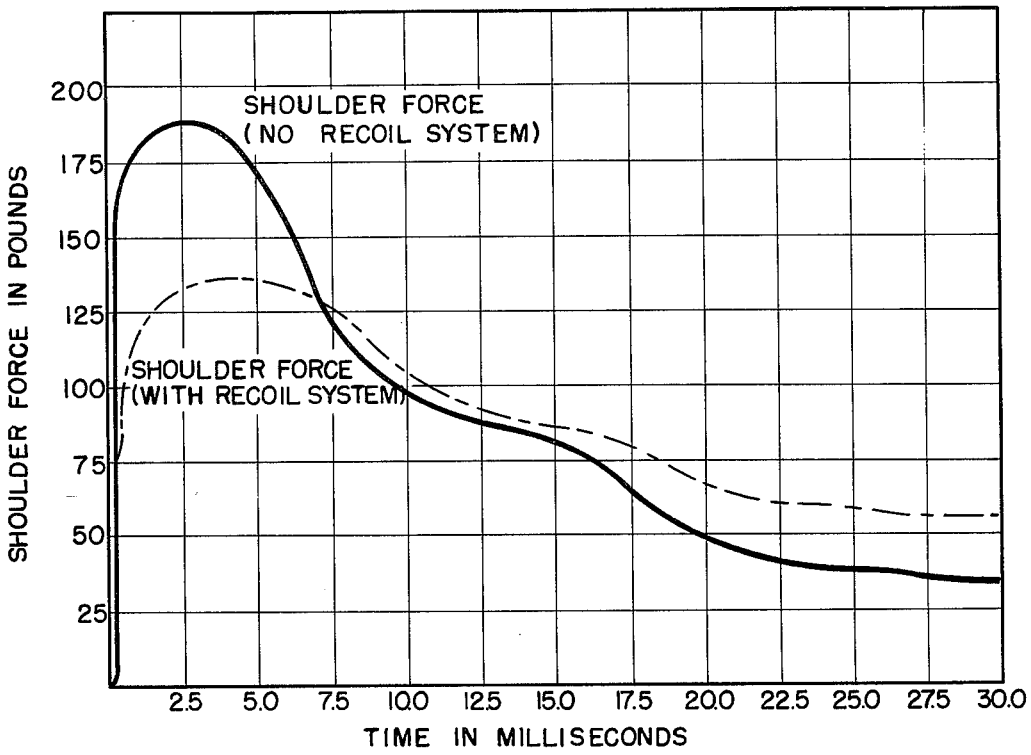
FIG. 10 is a graph showing a representative test plot of shoulder force vs. time for a "heavy" shouldered shooter.

FIGS. 9 and 10 are plots of actual test firings by a "light" shouldered shooter and a "heavy" shouldered shooter respectively. In FIG. 9, it can be seen that the shoulder force peaked at about 146 pounds when the "light" shouldered shooter, i.e. one who held the gun stock relatively loose in his shoulder before firing, fired without the recoil attenuation system actuated. With the recoil system actuated, the same shooter's peak shoulder force measured about 110 pounds.

FIG. 10 shows that the "heavy" shouldered shooter, i.e. one who pushes his gun well into his shoulder before firing, experienced a maximum peak shoulder force of about 188 pounds without the benefit of the recoil attenuating system while the same shooter experienced a peak shoulder force of about 136 pounds with the recoil system actuated.

Since the use of explosive propellent gases in firearms carries with it the problem of carbon and other products of combustion, it is important to provide for cleaning the recoil attenuating system. In the present case, this is easily accomplished by: (1) removing screws 26 to disengage seal ring 24, and (2) unscrewing breech plug 16 and then sliding the entire contents out of the gas cylinder 12, i.e. inertia weight, seal ring, coil, etc.

What is claimed is:

1. A recoil attenuation system for a firearm that reduces the recoil force felt by the shooter, said system comprising a barrel, a gas cylinder attached to said barrel, said gas cylinder having front and rear end walls, a stationary seal ring mounted in said cylinder intermediate its ends thereof to define a forward cylinder section and a rear cylinder section, a movable inertia means having a piston portion positioned for sliding movement in the rear cylinder section and an elongated piston rod portion connected to said piston portion and normally extending through said seal ring into said forward cylinder section, said piston rod portion having at least a portion thereof capable of being slidably moved into said rear cylinder section, means in the forward cylinder section for biasing said inertia means forwardly, a gas chamber in said cylinder defined at its forward end by said seal ring and at its rear by said inertia piston portion, gas port means leading from the barrel to said cylinder gas chamber for bleeding thereinto a portion of the gases produced by a cartridge fired in said barrel whereupon said inertia means is driven sharply to the rear opposite to the direction of travel of a fired cartridge projectile, said inertia means being slowed down in the rear cylinder section by the trapping and compressing of air by the inertia piston portion as it moves toward the rear end wall of the gas cylinder, relief port means in the rear cylinder section to allow the gas pressure to drop rapidly after the inertia piston portion passes the relief port means, and metering means to permit escape of the trapped air in the rear cylinder section to decrease the velocity of the inertia means.

2. A recoil attenuation system as recited in claim 1, wherein said metering means comprises an elongated opening through said inertia means that allows trapped air to vent through the opening into the forward section of the gas cylinder, and relief port means in the forward section of the cylinder that allows the vented air to escape from the cylinder.

3. A recoil attenuation system as recited in claim 1, in which said stationary seal ring is mounted in fixed position to said cylinder by means which are accessible from the outside of the cylinder so that the seal ring can be disengaged from said cylinder, said rear end wall of the gas cylinder being readily removable so that upon removal of said rear end wall and disengagement of said seal ring, the entire inertia means can be removed from the gas cylinder for cleaning purposes.

4. A system of reducing the recoil felt by a shooter after firing a firearm, said system comprising a barrel, a gas cylinder attached to said barrel, a movable inertia weight including a piston portion and a piston rod portion positioned in said gas cylinder, means for tapping a portion of the explosive gases produced by the firing of a cartridge in said barrel and conveying said gases to said gas cylinder to propel said inertia weight rearwardly within said gas cylinder, means for pneumatically slowing down the rearward movement of said inertia weight, spring means normally biasing said inertia weight forwardly but becoming compressed upon rearward acceleration of the inertia weight, said means for pneumatically slowing down the rearward movement of said inertia weight comprising a rear gas cylinder end closure so that upon rearward movement of said inertia weight piston portion toward said cylinder end closure, the air trapped therebetween is compressed to act as a buffer, vent means comprising an opening through said inertia weight that allows a metered portion of the compressed air to escape to the opposite end of the gas cylinder where relief ports permit the vented air to escape.

5. A system of reducing the recoil felt by a shooter as recited in claim 4, relief port means in said gas cylinder which are normally out of communication with said explosive gases until the piston portion of the inertia weight has been moved rearwardly by the gases past said relief port means whereupon the gas pressure driving the piston portion rearwardly drops rapidly.

6. A system of reducing the recoil felt by a shooter after firing a firearm, said system comprising a barrel, a gas cylinder attached to said barrel, a movable inertia weight including a piston portion and a piston rod portion positioned in said gas cylinder, means for tapping a portion of the explosive gases produced by the firing of a cartridge in said barrel and conveying said gases to said gas cylinder to propel said inertia weight rearwardly within said gas cylinder, means for pneumatically slowing down the rearward movement of said inertia weight, spring means normally biasing said inertia weight forwardly but becoming compressed upon rearward acceleration of the inertia weight, a stationary seal ring mounted in said gas cylinder, said inertia weight piston portion normally abutting the rear of said seal ring to limit forward movement of said inertia weight, said inertia weight piston rod portion projecting through said seal ring and extending forwardly thereof, said spring means abutting the forward end of said seal ring and a stop means on the forward end of said piston rod where upon rearward movement of said inertia weight the spring means is compressed so that when the inertia weight reaches its rearwardmost position and comes to a stop, the compressed spring means returns the inertia weight forwardly to its normal forward position.

* * * * *